US012117282B2

(12) United States Patent
Terry

(10) Patent No.: US 12,117,282 B2
(45) Date of Patent: Oct. 15, 2024

(54) PRIMER DELIVERY SYSTEMS AND METHODS

(71) Applicant: Dyno Nobel Asia Pacific Pty Limited, Southbank (AU)

(72) Inventor: Paul Terry, Melbourne (AU)

(73) Assignee: Dyno Nobel Asia Pacific Pty Limited, Southbank (AU)

( * ) Notice: Subject to any disclaimer, the term of this patent is extended or adjusted under 35 U.S.C. 154(b) by 0 days.

(21) Appl. No.: 18/176,866

(22) Filed: Mar. 1, 2023

(65) Prior Publication Data

US 2023/0280143 A1 Sep. 7, 2023

(30) Foreign Application Priority Data

Mar. 1, 2022 (AU) ..... 2022900487

(51) Int. Cl.

| | |
|---|---|
| ***F42D 1/22*** | (2006.01) |
| ***F42B 3/26*** | (2006.01) |
| ***F42D 1/04*** | (2006.01) |
| ***F42D 1/10*** | (2006.01) |
| ***F42D 1/18*** | (2006.01) |

(52) U.S. Cl.

CPC ..... *F42D 1/22* (2013.01); *F42B 3/26* (2013.01); *F42D 1/04* (2013.01); *F42D 1/10* (2013.01); *F42D 1/18* (2013.01)

(58) Field of Classification Search

CPC .... F42B 1/02; F42B 1/04; F42B 1/043; F42B 1/10; F42B 1/18; F42B 1/22; F42B 3/04; F42B 3/02; F42B 3/10; F42B 3/26; F42D 1/02; F42D 1/04; F42D 1/043; F42D 1/10; F42D 1/18; F42D 1/22; F42D 3/04; F42D 1/00; F42D 1/08

USPC ..... 102/313, 319

See application file for complete search history.

(56) References Cited

U.S. PATENT DOCUMENTS

| | | | | |
|---|---|---|---|---|
| 4,040,329 A * | 8/1977 | Ljungberg | ..... | F42D 1/10 86/20.15 |
| 7,210,409 B2 * | 5/2007 | Johnson | ..... | F42B 3/02 102/317 |
| 7,650,993 B2 * | 1/2010 | Bawabe | ..... | F42B 39/00 102/275.1 |
| 2022/0282958 A1 | 9/2022 | Sprague et al. | | |

FOREIGN PATENT DOCUMENTS

| | | | | |
|---|---|---|---|---|
| AU | 2004200371 A1 * | 8/2004 | ..... | F42B 3/02 |
| WO | WO-2020232506 A1 * | 11/2020 | ..... | E21C 37/00 |

* cited by examiner

*Primary Examiner* — James S Bergin
(74) *Attorney, Agent, or Firm* — Dorsey & Whitney LLP

(57) ABSTRACT

The present disclosure describes systems and methods for delivering a primer to an operative depth for initiating an explosion of an explosive material in a blasthole. Systems described herein can include a cap structure providing access into the hole and a separable detonator subassembly that can be deployed to convey a detonator to a priming position. Methods of priming a blasthole can include placing such a system on a blasthole collar and deploying the detonator subassembly in conjunction with loading the blasthole with explosive material.

20 Claims, 7 Drawing Sheets

PRIMER DELIVERY SYSTEMS AND METHODS

RELATED APPLICATIONS

This patent application is related to, and claims priority from, Australian Provisional Patent Application No. 2022900487, which is entitled "Primer delivery systems and methods" and was filed on Mar. 1, 2022, which is incorporated herein by reference in its entirety.

TECHNICAL FIELD

The present disclosure describes systems and methods in the field of blasting operations. More particularly the present disclosure describes systems and methods for delivering a primer to an operative depth for initiating an explosion of an explosive material in a blasthole.

SUMMARY OF THE INVENTION

According to one aspect of the present invention, there is provided a system for priming a blasthole, comprising:

a cap comprising:

a cap body having a top side, a bottom side, and a spool chamber disposed therein;

an aperture centrally placed with respect to the spool chamber and which penetrates the bottom side; and a hollow guide tube axially aligned with and in communication with the aperture, and having an upper end secured to the bottom side of the cap body and a lower end opposite the upper end; and a detonator subassembly comprising a detonator holder configured to secure a detonator in a priming orientation, and having an undeployed state and a deployed state, wherein in the undeployed state the detonator holder is removably secured to the lower end of the guide tube and in the deployed state the detonator holder is separated from the guide tube.

In some embodiments, the detonator subassembly further comprises: a detonator secured in the detonator holder; and a transmission line having a detonator end coupled to the detonator and a connector end opposite the detonator end, wherein the transmission line is substantially situated within the spool chamber in the undeployed state.

In some embodiments, at least part of the transmission line is coiled within the spool chamber. In some embodiments, at least part of the transmission line is coiled around a spool situated within the spool chamber.

In some embodiments, the spool chamber allows the transmission line to unwind and dispense through the aperture and the guide tube in the deployed state.

In some embodiments, the connector end includes a connector configured to connect the transmission line to a source of an initiation signal. In some embodiments, the connector comprises one of a wireless receiving module, a direct electrical connection, and a mechanical connection.

In some embodiments, the transmission line is any one of a detonating cord, an electrical wire, or a shock tube.

In some embodiments, the cap body has a generally circular shape.

In some embodiments, the spool chamber includes a hub. In some embodiments, the hub circumscribes the aperture. In some embodiments, the hub is circular or cylindrical in shape. The hub can be hollow and can define a through passageway. In some embodiments, the hub is integrally formed with the cap body. In other embodiments, the cap body and the hub are formed separately, wherein the hub can be secured or connected to the cap body. In some embodiments, the cap body and the hub are arranged concentrically with respect to each other.

In some embodiments, a height of the hub is less than a height of the cap body. In some embodiments, a lower edge of the hub is aligned with a lower edge of the cap body. In some embodiments, an upper end of the hub is lower than an upper edge or top side of the cap body, thereby to facilitate dispensing of the transmission line through the aperture and the passageway defined by the hub.

In some embodiments, the detonator holder is at least partially nested within the lower end of the guide tube in the undeployed state. In some embodiments, the detonator holder is secured within the lower end by friction.

In some embodiments, the detonator subassembly is configured to couple to an explosive material delivery hose.

In some embodiments, the spool chamber is open for access through the top side of the cap body. In some embodiments, the top side of the cap body includes a removable lid.

In some embodiments, the detonator holder further comprises a retention feature configured to maintain the detonator holder at a deployed position, or otherwise resist movement of the detonator holder away from the deployed position, in a blasthole by interacting with a wall of the blasthole.

In some embodiments, the retention feature comprises one or more arms that radially expand from the detonator holder to engage a wall of the blasthole. In some embodiments, the retention feature resists movement of the detonator holder within the blasthole in one direction to a greater degree than movement in the opposite direction.

In some embodiments, the guide tube is sized to be received within a collar of a blasthole by a friction fit sufficient to secure the cap in place. In some embodiments, the guide tube has an outer diameter from about 50 mm to about 300 mm, or more particularly from about 50 mm to about 150 mm, about 55 mm to about 80 mm, about 60 mm to about 75 mm, or about 75 mm to about 300 mm, or about 100 mm to about 250 mm.

According to another aspect of the present invention, there is provided a method of priming a blasthole, the method comprising the steps of:

providing the system as disclosed herein;

placing the cap body onto a collar of the blasthole so that the guide tube and detonator subassembly are directed into the blasthole;

advancing an explosive material delivery hose through the aperture and the guide tube to dislodge the detonator holder and push the detonator subassembly to a deployment position in the blasthole; and withdrawing the delivery hose from the deployment position to disengage the delivery hose from the detonator holder.

In some embodiments, the explosive material delivery hose couples to the detonator subassembly as the explosive material delivery hose is advanced through the aperture.

In some embodiments, the method further comprises discharging explosive material through the delivery hose and into the blasthole.

In some embodiments, the detonator subassembly is uncoupled from the explosive material delivery hose by discharging the explosive material.

In some embodiments, the method further comprises connecting the connector end to a source of an initiation signal.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Figure 1A:
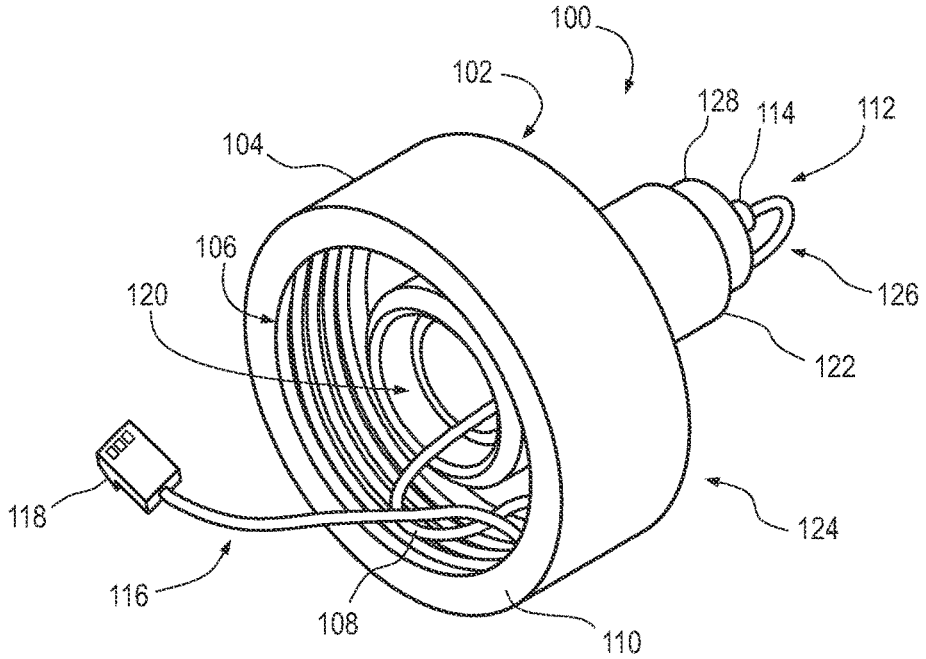
FIG. 1A is a perspective view of a primer delivery system in accordance with an embodiment.

In the following detailed description, reference is made to the accompanying drawings which form a part hereof and, in which are shown by way of illustration, specific embodiments of the disclosure that may be practiced. These embodiments are described in sufficient detail to enable those of ordinary skill in the art to practice the invention, and it is to be understood that other embodiments may be utilized, and that structural, logical, and electrical changes may be made within the scope of the disclosure. From the following description, it should be understood that components of the embodiments as generally described and illustrated in the figures herein could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

The phrases "connected to" and "coupled to" refer to any form of interaction between two or more entities, including mechanical, electrical, magnetic, electromagnetic, fluid, and thermal interaction. Two components may be connected or coupled to each other even though they are not in direct contact with each other. For example, two components may be coupled to each other through an intermediate component, or by an electromagnetic signal.

One of the operations in a drill-and-blast process involves locating detonation devices into blastholes. The detonation devices typically contain a small charge of explosive material. The purpose of the detonation devices is to initiate an explosion of an explosive material, such as a bulk explosive material, in the blasthole. Each detonation device is hereinafter referred to as a "primer".

More specifically, the term "primer" as used herein is understood to refer to a construct typically containing a small charge of explosive material that can be located in a blasthole for the purpose of initiating explosion of an explosive material in the blasthole. The primer can comprise or consist of a detonator configured to explode upon receipt of an initiation signal. As used herein "initiation signal" refers to any transient phenomenon that is typically conveyed by a given type of transmission line to directly or indirectly trigger detonation. This signal may itself be an explosive shock generated by other explosive material; an electrical current; or an electronic transmission, each of which may be conveyed to the detonator by a suitable transmission line in operable connection with the detonator. The primer may further comprise additional explosive material that is more sensitive to explosion of the detonator than the bulk explosive material.

Effective priming of blastholes at a blast site can present a number of operational challenges. As priming materials can include sensitive explosive materials, direct handling of these materials during transportation and placement presents risk of injury to persons involved. Similar risks are involved in manually delivering a primer deep enough into a blasthole for effective priming, particularly if the primer is dropped down the hole. Also, priming multiple holes in a blasting area can result in numerous transmission lines in which a section thereof is exposed above ground, so that on-site personnel must take extra care to avoid disturbing them when moving about the site.

Figure 1B:
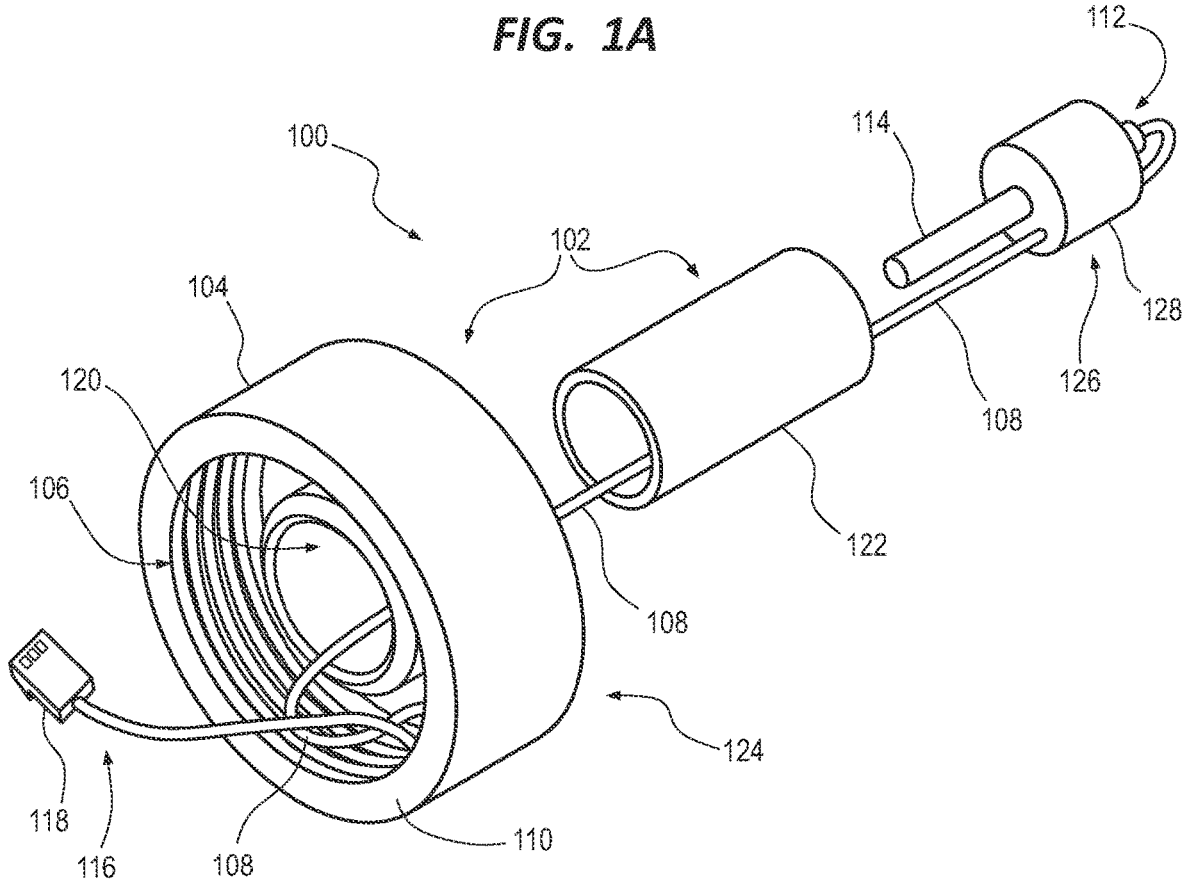
FIG. 1B is an exploded perspective view of the primer delivery system of FIG. 1A.

Systems for priming a blasthole as described herein can include structure(s) adapted to place a detonator and transmission line in a readily deployable position relative to a blasthole. In one aspect, this can include situating the transmission line so as to allow an end of the line coupled to a detonator to readily travel down-hole, while making the other end accessible for integration into the blast initiation process. Various features of such systems may be readily understood by reference to the example embodiment shown in FIG. 1A through FIG. 1C. Referring to the views provided in these figures, a system 100 can comprise a cap 102 adapted for stationary placement at the collar of a blasthole while positioning a primer for down-hole deployment. For example, the cap 102 can comprise a cap body 104 having a shape and size that allows it to sit across the width of the hole. As illustrated in FIG. 1A and FIG. 1B, in some embodiments the cap body 104 can have a generally circular or cylindrical shape. In some embodiments, the cap body can have other shapes including, but not limited to, rectangular, cross-shaped, star-shaped, and oval. The cap body 104 can have a width or diameter that allows the cap 102 to span a width or diameter of the blasthole collar so as to substantially reduce the risk that the cap 102 might fall into the blasthole.

The cap 102 can further comprise a spool chamber 106 disposed within the cap body 104. The spool chamber 106 can be configured to contain a length of transmission line 108 sufficient to reach a desired location in the blasthole. The spool chamber 106 can also allow the transmission line 108 to be arranged in an orderly fashion that allows a length of the transmission line 108 to be dispensed into the blasthole with little to no tangling or snagging. For example, the spool chamber 106 may allow the transmission line 108 to rest therein in a coiled state as shown in each of FIG. 1A through FIG. 1C. It will be appreciated that such a coiled transmission line 108 will have a corresponding coil height. The cap 102 can be configured to be of a predetermined height such that the spool chamber 106 formed therein has a height sufficient to accommodate coiled transmission lines 108 up to a predetermined coil height. As described in further detail below, this can enable the cap 102 to be placed on the collar 14 of the blasthole, in use, so that the cap body 104 and the coiled transmission line 108 (which is housed within the spool chamber 106) are situated over the blasthole.

In various embodiments, the spool chamber 106 can include one or more features to facilitate loading and coiling of a transmission line 108 therein. The cap body 104 may be configured to provide access to the spool chamber 106, for example by having a top side 110 that is substantially open, as illustrated in each of FIG. 1A through FIG. 1C, or that includes a removable lid. In some embodiments, the spool chamber 106 may include a centrally placed hub about which the transmission line 108 may be wound. In some embodiments, the walls of the spool chamber 106 may include ridges and/or furrows to support and stabilize coils of the transmission line 108. In some cases, transmission lines 108 for use in blasting applications may be obtained in pre-wound spools. In some embodiments, the spool chamber 106 is configured so that such a spool may be placed therein.

Figure 1C:
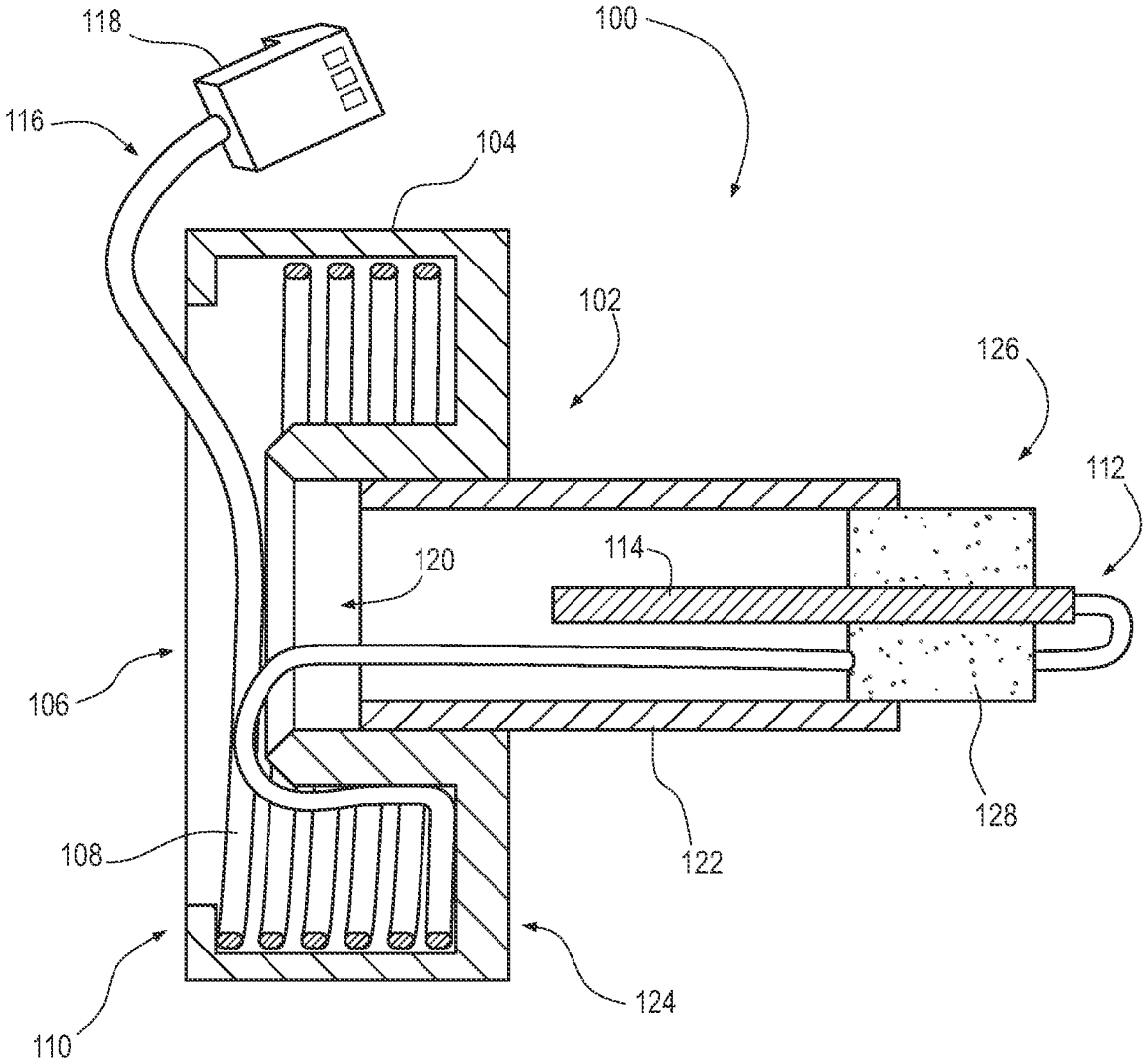
FIG. 1C is a cross-sectional view of the primer delivery system of FIG. 1A.

In the illustrated embodiment, as most clearly seen in FIG. 1C, the cap body 104 has a retaining formation in the form of an inwardly protruding (circular) lip or flange extending from, adjacent to or otherwise associated with the top side 110 of the cap body 104, thereby to inhibit movement of the coiled transmission line 108 away from the spool chamber 106 and thus assist in retaining the coiled transmission line 108 within the spool chamber 106. In the illustrated embodiment, the inwardly protruding lip or flange is circular and extends continuously around the top side 110 of the cap body 104. It will be appreciated that the retaining formation is not limited to such a configuration and may have an interrupted profile. For example, the retaining formation may include one or more discrete elements arranged in relative spaced apart relation about, or adjacent to, the top side edge of the cap body 104.

The transmission line 108 comprises a detonator end 112 operably connected to a detonator 114 that is appropriate for initiating detonation of the main charge explosive, either directly or through an intermediate explosive charge. The transmission line 108 further includes a connector end 116 opposite the detonator end 112, where said connector end 116 is configured for receiving a blast initiation signal and conveying the signal to the transmission line 108, which then propagates the signal to the detonator 114. The present disclosure encompasses systems for use with various blast initiation methods and equipment. Various types of transmission lines 108 may be used with the systems described herein. For example, a non-electric detonator may be coupled to a non-electric transmission line such as a detonating cord or a shock tube. In other embodiments, an electric detonator may be coupled to an electric transmission line comprising one or more electric wires. In some embodiments, an electronic detonator such as an electronic delay detonator may be coupled to either an electric or non-electric transmission line.

In some embodiments, the connector end 116 can include a connector 118 configured to connect the transmission line 108 to a source of an initiation signal. The nature of the initiation signal and the connector 118 may depend on the type of initiation approach being used and the type of transmission line 108 and detonator 114 with which the blasthole is primed. For example, a nonelectric initiation system in which the initiation signal is a propagating shock wave can involve use of a nonelectric transmission line, such as a detonator cord or shock tube, and the connector 118 may provide a mechanical connection between the transmission line 108 and a compatible above-ground trunk line. Electric initiation may involve the use of an electric transmission line suited to conduct a trigger signal to the detonator. In such cases, the connector 118 can be configured to provide a direct electrical connection between the transmission line 108 and an electrical blasting circuit. In a wireless initiation system, the connector 118 may be a wireless receiving module capable of participating in a wireless connection with a remote blast control unit.

The cap 102 can comprise an aperture 120 to provide access to the blasthole through the cap body 104. This access can be further facilitated by a hollow guide tube 122 secured to the bottom side 124 of the cap body 104, where said guide tube 122 is in communication with and axially aligned with the aperture 120. As illustrated in FIG. 1A through FIG. 1C, the relative arrangements of the coiled transmission line 108 and aperture 120 can allow the transmission line 108 to unwind and dispense through the aperture 120 of the cap body 104 and the guide tube 122. Furthermore and as foreshadowed, this arrangement can enable the cap 102 to be placed on the collar 14 of the blasthole so that the cap body 104 and the coiled transmission line 108 housed within the spool chamber 106 are situated over the blasthole and the guide tube 122 is directed into the blasthole.

In one aspect, the guide tube 122 provides a path to direct the transmission line 108 as it is dispensed from the spool chamber 106. In another aspect, the aperture 120 and guide tube 122 can provide a path through which the blasthole can be charged with explosive material, e.g., a bulk explosive. Bulk explosives include simple ANFO (ammonium nitrate+ fuel oil), water-in-oil emulsions, watergels, and various blends thereof. Though these materials can be viscous and/or dense, they are often delivered to the blasthole in a somewhat flowable state, and discharged into the blasthole via a delivery hose. Accordingly, the aperture 120 and guide tube 122 may each have an inner diameter through which an explosive delivery hose can readily pass. More particularly, the inner diameter of each of these features is sufficient to simultaneously accommodate both the delivery hose 16 and the transmission line 108. The outer diameter of the guide tube 122 is preferably selected to allow it to fit within the blasthole collar. In some embodiments, the outer diameter of the guide tube 122 is selected to provide a friction fit with the blasthole collar to facilitate secure placement of the system 100. In various embodiments, the outer diameter of the guide tube 122 may be from about 50 mm to about 300 mm, or more particularly from about 50 mm to about 150 mm, about 55 mm to about 80 mm, about 60 mm to about 75 mm, or about 75 mm to about 300 mm, or about 100 mm to about 250 mm.

The system 100 can further comprise a detonator subassembly 126 that is deployable to a desired priming location in the blasthole, e.g., the bottom of said hole in bottom-priming methods. Stated somewhat differently, the detonator subassembly 126 can serve at least two roles: 1.) removably secure the detonator 114 to the system 100 in an undeployed state; and 2.) capable of being deployed to deliver the detonator 114 to a suitable priming position in the blasthole and securing it there until detonation. Accordingly, the detonator subassembly 126 can comprise, in addition to the detonator 114 itself, a detonator holder 128 configured to secure the detonator 114 in a suitable position for priming.

More specifically, the detonator holder 128 can secure the detonator 114 in an orientation so that its explosive charge will be directed toward the explosive material. One example of this configuration is shown in the various views of FIG. 1A through FIG. 1C, in which the detonator holder 128 is configured so that it holds the detonator 114 in a proper orientation for bottom-hole priming.

The present disclosure encompasses detonator holders that can accommodate and deliver a priming package that includes priming elements in addition to a detonator. For example, in blasting applications involving explosives that are not detonator-sensitive, effective priming may involve the use of a detonator-sensitive intermediate charge, i.e., a primer, and in some cases, an additional charge, termed a booster, as well. Primers and primer/booster combinations can be obtained as a packaged unit. In some embodiments the detonator holder 128 is configured to hold such a package and a detonator in a mutual arrangement suitable for triggering of the intermediate charge(s) by the detonator.

As noted above, the detonator holder 128 can be deployed to convey the detonator 114 to a deployment position in the blasthole. As also noted above, the systems described herein may be configured to remain in place during charging of the blasthole with a bulk explosive, as an explosive delivery hose can be introduced into the blasthole through the cap structure. In some embodiments, the system is configured so that deployment of the detonator subassembly 126 may be accomplished by the blasthole loading process. As illustrated in FIG. 1C, the detonator holder 128 can be removably secured to the guide tube 122 so that the detonator holder 128 rests in the path a delivery hose will take when passing through the guide tube 122. As a result, the delivery hose pushes against and dislodges the detonator subassembly 126 from the guide tube 122. The means by which the detonator holder 128 is secured to the guide tube 122 may provide an attachment that is secure in the undeployed state, but is readily overcome by insertion of the delivery hose. In some embodiments, as shown in FIG. 1A and FIG. 1C, the detonator holder 128 can be sized to fit at least partially within the guide tube 122, such as at the distal end of the guide tube 122. In such an arrangement, the relative sizes of the detonator holder 128 and the guide tube 122 may be selected so that the detonator holder 128 is secured in place by friction. The use of other means of securing the detonator holder 128 in place, such as adhesives and snap-fit features, are also encompassed by the present disclosure.

In some embodiments, the detonator subassembly 126 may include one or more features to couple to, mate with, or provide a more secure engagement with the end of a delivery hose during deployment. For example, an end of the detonator holder 128 may include a cylindrical recess sized to receive, couple to, and/or mate with the end of the delivery hose when said end contacts the detonator holder 128. In another example, an end of the detonator holder 128 may include a projection (e.g., a cylindrical projection) sized to enter the end of the hose when said end contacts the detonator holder 128.

Figure 2:
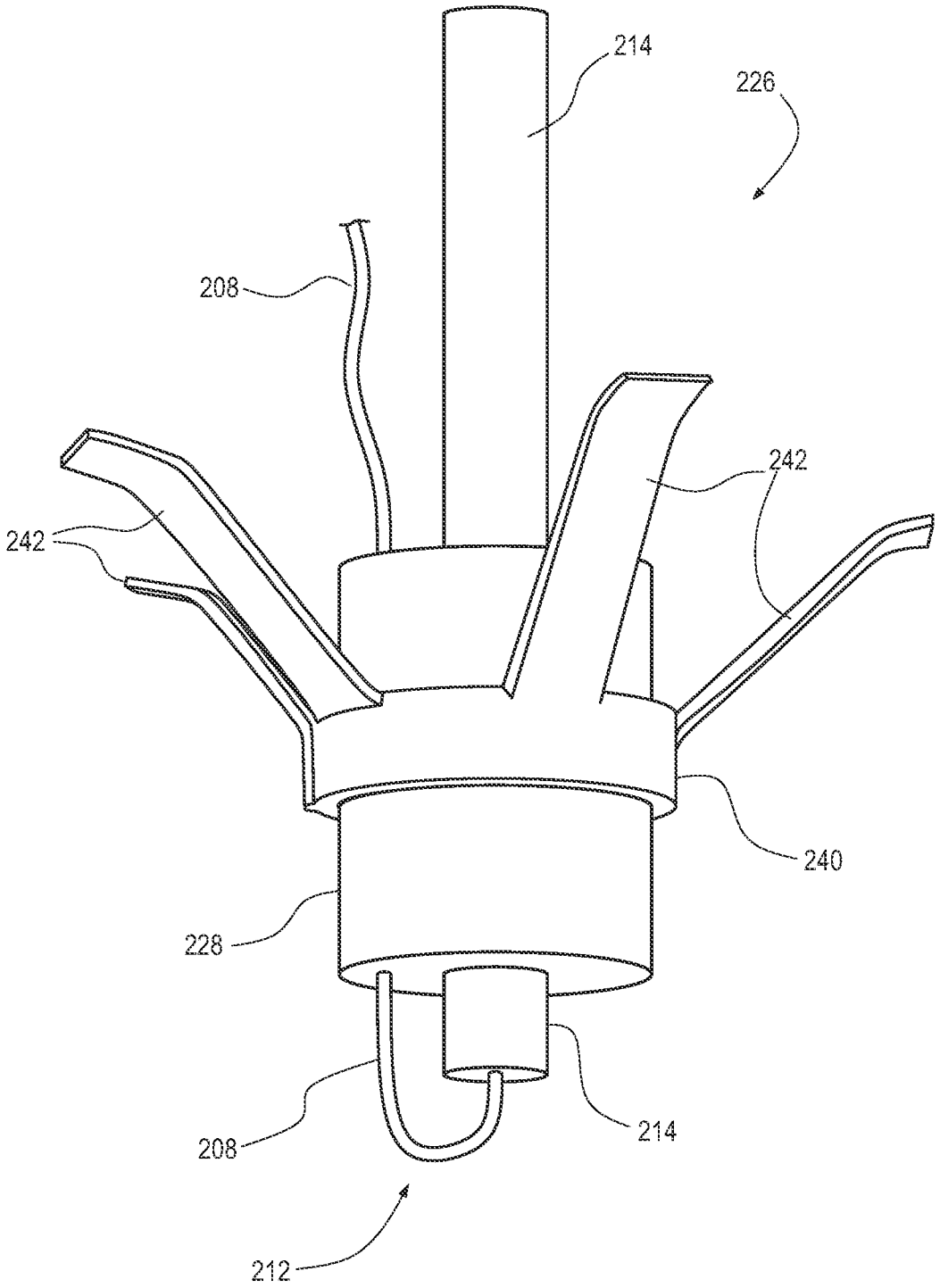
FIG. 2 is a perspective view of a component of a primer delivery system in accordance with an embodiment.
Figure 3A:
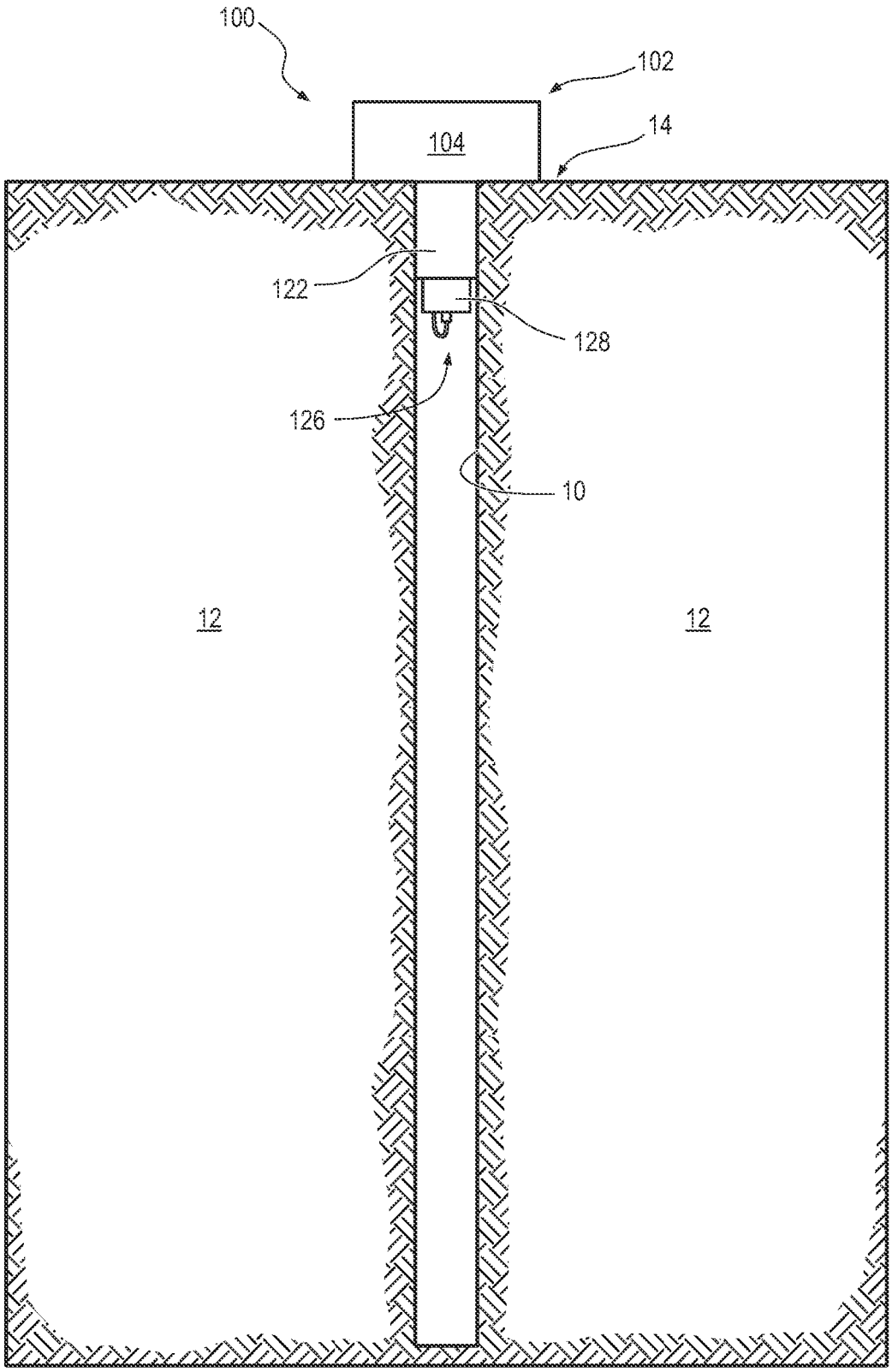
FIG. 3A illustrates a method of use of the system of FIG. 1A in accordance with an embodiment.
Figure 3B:
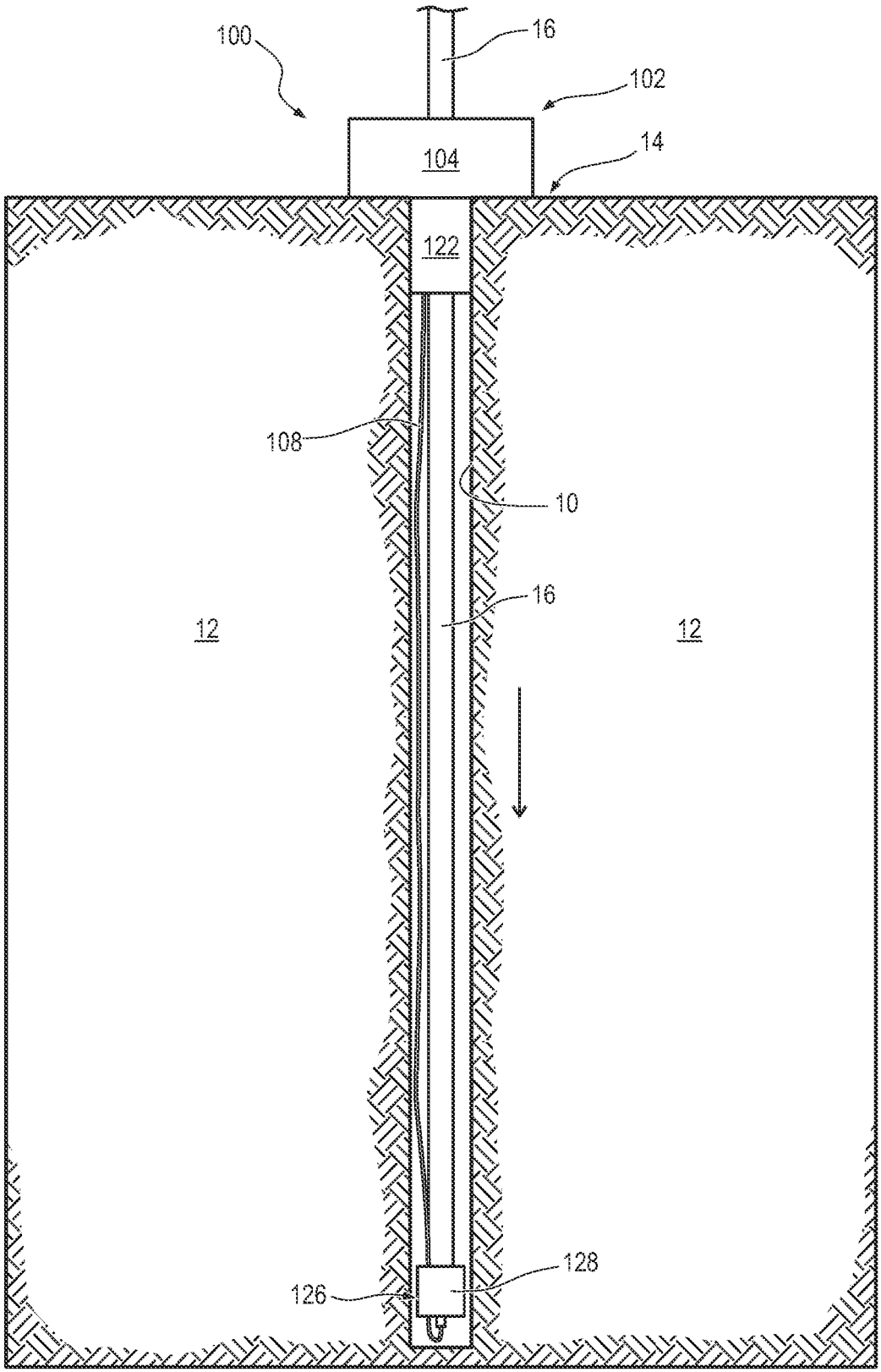
FIG. 3B depicts a further step in the method of use illustrated in FIG. 3A.
Figure 3C:
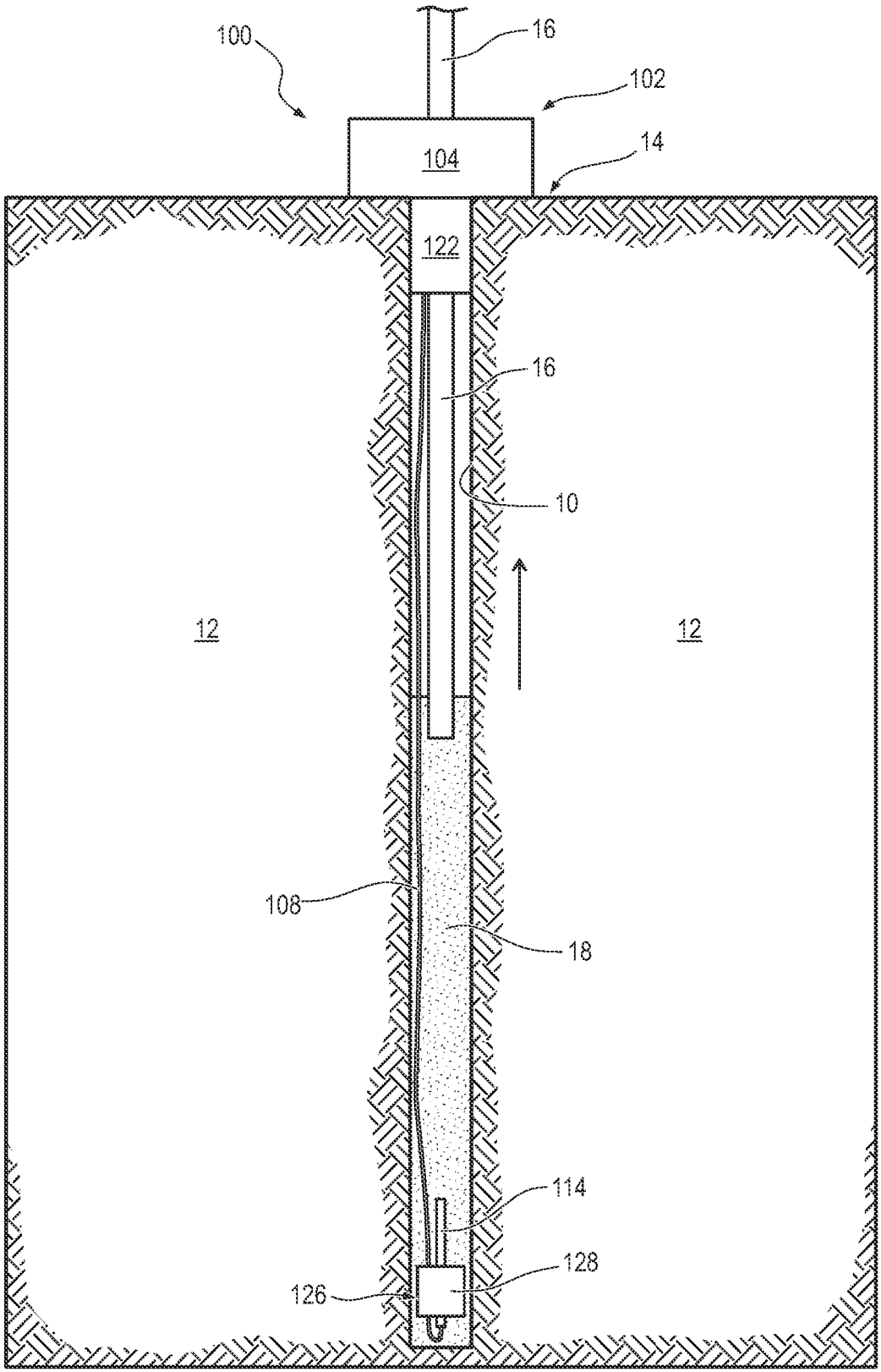
FIG. 3C depicts a further step in the method of use illustrated in FIG. 3A and FIG. 3B.
Figure 3D:
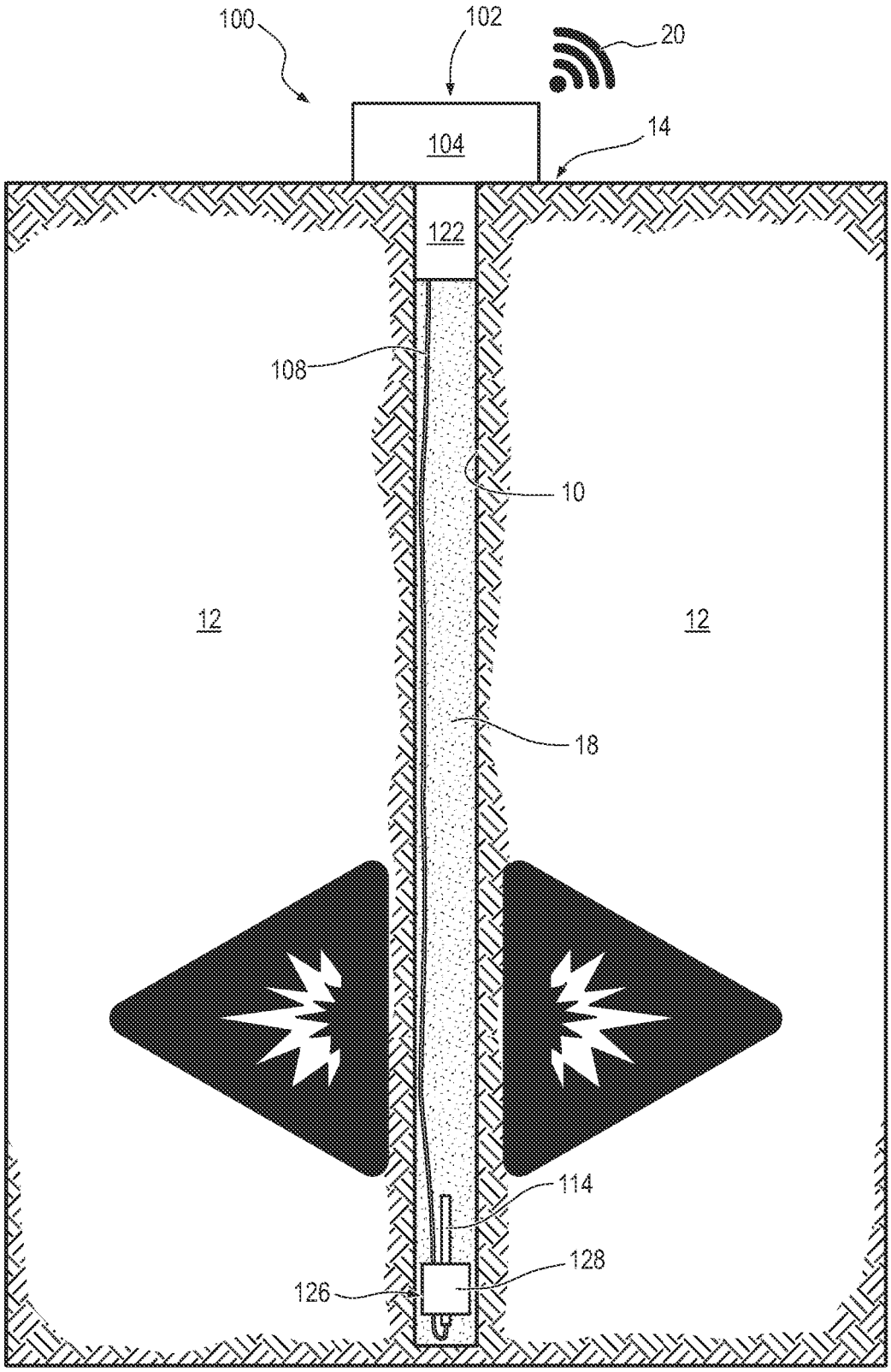
FIG. 3D depicts a further step in the method of use illustrated in FIG. 3A through FIG. 3C.

FIG. 2 through FIG. 3D present views of various embodiments of systems and components thereof described in connection with FIG. 1A through FIG. 1C. It will be appreciated that all the illustrated embodiments may have analogous features. Accordingly, like features are designated with like reference numerals, with the leading digits incremented. Relevant disclosure set forth above regarding similarly identified features thus may not be repeated hereafter. Moreover, specific features of the system and related components shown in FIG. 1A through FIG. 1C may not be shown or identified by a reference numeral in the drawings or specifically discussed in the written description that follows. However, such features may clearly be the same, or substantially the same, as features depicted in other embodiments and/or described with respect to such embodiments.

In some embodiments, the detonator holder 128 can include one or more features to facilitate securement of a detonator 114 in a priming location within the blasthole until blast initiation. For example such features may be designed to prevent the detonator subassembly from drifting back toward the collar due to e.g., inadvertent pulling of the transmission line or pressure applied by the surrounding explosive material. In some embodiments, the detonator subassembly 126 can comprise a retention feature that interacts with surfaces within the blasthole to accomplish this function. FIG. 2 shows a detonator subassembly 226 according to an embodiment, comprising a detonator 214 connected to a detonator end 212 of a transmission line 208, where the detonator 214 is secured in a detonator holder 228. The detonator holder 228 further includes a retention feature 240 comprising a plurality of arms 242 configured to interact with a wall of a blasthole into which the detonator subassembly 226 is deployed. As illustrated, the arms 242 can be configured to engage the wall of the blasthole so as to allow the detonator subassembly 226 to be moved in the hole in one direction, but to resist movement in the opposite direction. The arms 242 may be spring-loaded or otherwise configured to flex so that they expand outward and press against the blasthole wall to provide resistance to movement of the detonator subassembly 226. This resistance may also aid in controlling the descent of the detonator subassembly in down-hole priming, thereby reducing the risk of damage to the detonator subassembly and possible premature detonation. The arms 242 can also be oriented so that this pressure increases significantly upon movement in the undesired direction, e.g., back toward the collar. The retention feature 240 can also aid in centering the detonator holder 228 within the blasthole. It will be appreciated that the retention feature 240 shown in FIG. 2 illustrates one such configuration; however other configurations that provide similar function are also encompassed by the present disclosure.

The systems described above can be used to place a primer at each blasthole in a blast site and to safely and effectively deliver the primer to an operative location in the blasthole. Such systems provide a package for a detonator and transmission line that facilitates safe handling and placement of these materials within the site. Use of such system can also enhance site safety by providing orderly arrangement of multiple primer transmission lines while preserving ready accessibility to the same. Furthermore, actual priming of each blasthole need not involve either manual deployment, which can be unreliable and/or hazardous, or the use of additional elaborate vehicles or machinery. Rather, priming can be accomplished as part of the step of loading the hole with bulk explosive material.

FIG. 3A through FIG. 3D show an exemplary use of such a system, i.e., the system 100 described in FIG. 1A through FIG. 1C, in a method of priming a blasthole. It should be noted that, while these figures depict a vertical, downward oriented blasthole, the systems and methods described herein may be used with holes having other orientations, such as upward or horizontal. The systems and methods can also be used in above ground or below ground (underground) blasting applications. As shown in FIG. 3A the method can comprise placing a primer delivery system 100 at a blasthole 10 drilled into a formation 12. More particularly, the cap 102 can be placed on the collar 14 of the blasthole 10 so that the cap body 104 is situated over the blasthole 10 and the guide tube 122 and detonator subassembly 126 are directed into the blasthole 10. As shown in FIG. 3A, the cap body 104 may span the width of the blasthole 10 at the collar 14. As also shown, the guide tube 122 may extend some distance into the blasthole 10.

As shown in FIG. 3B, deployment of the detonator subassembly 126 can be accomplished in conjunction with a process of loading the blasthole with an explosive material. This can comprise introducing a delivery hose 16 into the blasthole 10 by advancing the delivery hose 16 through the cap body 104 and the guide tube 122 in the direction indicated by the arrow. The detonator holder 128 is separated from the guide tube 122 by the advancing delivery hose 16 and pushed to the end or bottom of the blasthole. The transmission line 108 is dispensed from the spool chamber (not shown), through the guide tube 122, and down the hole as the detonator holder 128 travels downward or otherwise along the blasthole. In some embodiments, the relative sizes of the detonator holder 128 and delivery hose 16 are selected so that the detonator holder 128 is pushed by the delivery hose 16 without becoming stuck to or otherwise ensnared by the end of the delivery hose 16. In certain embodiments, the relative sizes and/or structures of the detonator holder 128 and delivery hose 16 are such that the delivery hose 16 couples to or otherwise mates with an end of the detonator holder 128 during insertion of the delivery hose 16.

As shown in FIG. 3C, once the detonator subassembly 126 has been advanced to the deployment position (e.g., the bottom of the blasthole 10 as shown) the delivery hose 16 may be withdrawn. The detonator holder 128 is thereby disengaged from the delivery hose 16 and remains down the blasthole 10. In some embodiments, as illustrated in FIG. 3C, an explosive material 18 may be discharged through the delivery hose 16 and into the blasthole 10 during withdrawal of the delivery hose 16. Discharging and withdrawal may commence substantially coincidentally, or discharging may commence at some point after withdrawal begins. In particular embodiments, the detonator holder 128 is disengaged from the delivery hose 16 by discharging the explosive material 18 through the delivery hose 16. For instance, the explosive material 18 can push against the detonator holder 128 to disengage the detonator holder 128 from a state in which it is coupled to the delivery hose 16.

As shown in FIG. 3D, after loading with explosive material 18 and removal of the delivery hose 16 the blasthole 10 is primed and charged. In some embodiments, the material may undergo conditioning processes in preparation for detonation. These include, but are not limited to, sensitization and increases in viscosity. Such processes may be initiated before or during discharge of the explosive material 18 into the blasthole 10, and may proceed for some time thereafter. Stemming material may be introduced into the blasthole. In some embodiments, such material may be introduced into the blasthole through the aperture and guide tube.

The method can further comprise connecting the detonator subassembly 126 to a source of an initiation signal 20 suited to propagate down the transmission line 108 and trigger detonation of the detonator 114. In various embodiments, this can be accomplished via the connector end (not shown) of the transmission line 108, such as through a connector (not shown) operably connected thereto. The nature of the initiation signal may depend on the type of initiation approach being used and the type of transmission line and detonator with which the blasthole is primed. For example, a nonelectric initiation system in which the initiation signal 20 is a propagating shock wave can involve use of a nonelectric transmission line, such as a detonator cord or shock tube, and a mechanical connector may be used to connect the transmission line to a compatible above-ground trunk line. Electric initiation may involve the use of an electric transmission line suited to conduct a trigger signal to the detonator. In such cases, the connector can be configured to provide an electrical connection to an electric blasting circuit. In a wireless initiation system, the connector may be a wireless receiving module capable of participating in a wireless connection with a remote blast control unit. Accordingly, it is contemplated that various types of initiation systems can be used to initiate the detonator 114.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

The invention claimed is:

1. A system for priming a blasthole, comprising:

a cap comprising:

a cap body having a top side, a bottom side, and a spool chamber disposed therein;

an aperture centrally placed with respect to the spool chamber and which penetrates the bottom side; and a hollow guide tube axially aligned with and in communication with the aperture, and having an upper end secured to the bottom side of the cap body and a lower end opposite the upper end; and a detonator subassembly comprising a detonator holder configured to secure a detonator in a priming orientation, and having an undeployed state and a deployed state, wherein in the undeployed state the detonator holder is removably secured to the lower end of the guide tube and in the deployed state the detonator holder is separated from the guide tube.

2. The system of claim 1, wherein the detonator subassembly further comprises:

a detonator secured in the detonator holder; and a transmission line having a detonator end coupled to the detonator and a connector end opposite the detonator end, wherein the transmission line is substantially situated within the spool chamber in the undeployed state.

3. The system of claim 2, wherein at least part of the transmission line is coiled within the spool chamber or around a spool situated within the spool chamber.

4. The system of claim 2, wherein the spool chamber allows the transmission line to unwind and dispense through the aperture and the guide tube in the deployed state.

5. The system of claim 2, wherein the connector end includes a connector configured to connect the transmission line to a source of an initiation signal.

6. The system of claim 5, wherein the connector comprises one of a wireless receiving module, a direct electrical connection, and a mechanical connection.

7. The system of claim 2, wherein the transmission line is any one of a detonating cord, an electrical wire, or a shock tube.

8. The system of claim 1, wherein the spool chamber includes a hub circumscribing the aperture.

9. The system of claim 1, wherein the detonator holder is at least partially nested within the lower end of the guide tube in the undeployed state.

10. The system of claim 9, wherein the detonator holder is secured within the lower end by friction.

11. The system of claim 1, wherein the detonator subassembly is configured to couple to an explosive material delivery hose.

12. The system of claim 1, wherein the detonator holder further comprises a retention feature configured to maintain the detonator holder at a deployed position in a blasthole by interacting with a wall of the blasthole.

13. The system of claim 1, wherein the guide tube is sized to be received within a collar of a blasthole by a friction fit sufficient to secure the cap in place.

14. The system of claim 1, wherein the guide tube has an outer diameter from about 50 mm to about 300 mm.

15. A method of priming a blasthole, comprising:

providing the system of claim 2;

placing the cap body onto a collar of the blasthole so that the guide tube and detonator subassembly are directed into the blasthole;

advancing an explosive material delivery hose through the aperture and the guide tube to dislodge the detonator holder and push the detonator subassembly to a deployment position in the blasthole; and withdrawing the delivery hose from the deployment position to disengage the delivery hose from the detonator holder.

16. The method of claim 15, wherein the explosive material delivery hose couples to the detonator subassembly as the explosive material delivery hose is advanced through the aperture.

17. The method of claim 15, further comprising discharging explosive material through the delivery hose and into the blasthole.

18. The method of claim 17, wherein the detonator subassembly is uncoupled from the explosive material delivery hose by discharging the explosive material.

19. The method of claim 15, further comprising connecting the connector end to a source of an initiation signal.

20. A system for priming a blasthole, comprising:

a cap comprising:

a cap body having a top side, a bottom side, and a spool chamber disposed therein;

an aperture centrally placed with respect to the spool chamber and which penetrates the bottom side; and a hollow guide tube axially aligned with and in communication with the aperture, and having an upper end secured to the bottom side of the cap body and a lower end opposite the upper end such that the guide tube extends outwardly of the cap body from the bottom side; and a detonator subassembly comprising a detonator holder configured to secure a detonator in a priming orientation, and having an undeployed state and a deployed state, wherein in the undeployed state the detonator holder is removably secured to the lower end of the guide tube and in the deployed state the detonator holder is separated from the guide tube.

* * * * *